US008115715B2

(12) United States Patent
Hong

(10) Patent No.: US 8,115,715 B2
(45) Date of Patent: Feb. 14, 2012

(54) LIQUID CRYSTAL DISPLAY DEVICE AND METHOD OF DRIVING THE SAME

(75) Inventor: Hyung-Ki Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1082 days.

(21) Appl. No.: 12/005,349

(22) Filed: Dec. 27, 2007

(65) Prior Publication Data

US 2009/0009493 A1 Jan. 8, 2009

(30) Foreign Application Priority Data

Jul. 6, 2007 (KR) ..... 10-2007-0067868

(51) Int. Cl.
*G09G 3/36* (2006.01)

(52) U.S. Cl. ..... 345/89; 345/95

(58) Field of Classification Search ..... 345/87–89, 345/95, 98–100
See application file for complete search history.

(56) References Cited

U.S. PATENT DOCUMENTS

| | | | | |
|---|---|---|---|---|
| 7,532,185 | B2 * | 5/2009 | Lee et al. | 345/89 |
| 2005/0157225 | A1 * | 7/2005 | Toyooka et al. | 349/99 |
| 2006/0051526 | A1 * | 3/2006 | Fukagawa et al. | 428/1.31 |
| 2006/0221023 | A1 * | 10/2006 | Inoue et al. | 345/87 |
| 2006/0274003 | A1 * | 12/2006 | Inoue et al. | 345/87 |
| 2006/0279497 | A1 * | 12/2006 | Sasaki et al. | 345/87 |
| 2007/0146887 | A1 * | 6/2007 | Ikeda et al. | 359/586 |
| 2010/0165257 | A1 * | 7/2010 | Saitoh et al. | 349/75 |
| 2010/0207859 | A1 * | 8/2010 | Tanaka et al. | 345/89 |

OTHER PUBLICATIONS

McCartney, Richard I.; "A Liquid Crystal Display Response Time Compensation Feature Integrated into an LCD Panel Timing Controller"; SID Symposium Digest of Technical Papers; May 2003; pp. 1350-1353; vol. 34, Issue 1; Society for Information Display, U.S.A.

* cited by examiner

*Primary Examiner* — Ricardo L Osorio
(74) *Attorney, Agent, or Firm* — Morgan, Lewis & Bockius LLP

(57) ABSTRACT

A liquid crystal display device includes a liquid crystal panel including a liquid crystal layer; and a driving circuit including a data driver supplying a data voltage to the liquid crystal panel, wherein the liquid crystal panel displays white at a first data voltage and black at a second data voltage, and wherein a level of the first data voltage is higher than 0V and a level of the second data voltage is higher than the level of the first data voltage.

9 Claims, 4 Drawing Sheets

LIQUID CRYSTAL DISPLAY DEVICE AND METHOD OF DRIVING THE SAME

BACKGROUND

1. Priority Claim

This application claims the benefit of priority from Korean Patent Application No. 10-2007-0067868, filed on Jul. 6, 2007, which is hereby incorporated by reference in its entirety.

2. Technical Field

The present invention relates to a liquid crystal display device and a method of driving the same.

3. Related Art

Some display devices use cathode-ray tubes (CRTs). Other display devices may be flat panel displays, such as liquid crystal display (LCD) devices, plasma display panels (PDPs), field emission displays (FED), and electro-luminescence displays (ELDs). Some of these flat panel displays may be driven by an active matrix driving method in which a plurality of pixels arranged in a matrix configuration are driven using a plurality of thin film transistors. Among these active matrix type flat panel displays, liquid crystal display (LCD) devices and electroluminescent display (ELD) devices may exhibits a higher resolution, and increased ability to display colors and moving images as compared to some of the other flat panel display devices.

An LCD device may include two substrates that are spaced apart and face each other with a layer of liquid crystal molecules interposed between the two substrates. The two substrates may include electrodes that face each other. A voltage applied between the electrodes may induce an electric field across the layer of liquid crystal molecules. The alignment of the liquid crystal molecules may be changed based on an intensity of the induced electric field, thereby changing the light transmissivity of the LCD device. Thus, the LCD device may display images by varying the intensity of the electric field across the layer of liquid crystal molecules.

FIG. 1 is a block diagram of an LCD device according to the related art. FIG. 2 is a circuit diagram of a liquid crystal panel of FIG. 1, and FIG. 2 is a waveform view illustrating gate voltages output from a gate driver of FIG. 1.

Referring to FIG. 1, the LCD device includes a liquid crystal panel 3 and a driving circuit. The driving circuit 26 may include gate and data drivers 2 and 1.

The liquid crystal panel 3 includes a plurality of gate lines GL1 to GLm along a first direction and a plurality of data lines DL1 to DLn along a second direction.

The plurality of gate lines GL1 to GLm and the plurality of data lines DL1 to DLn cross each other to define a plurality of pixels. Each pixel includes a thin film transistor TFT, a liquid crystal capacitor LC, and a storage capacitor Cst. The liquid crystal capacitor LC includes a pixel electrode connected to the thin film transistor TFT, a common electrode, and a liquid crystal layer between the pixel and common electrodes.

The gate driver 2 sequentially output gate voltages to the gate lines GL1 to GLm. Referring to FIG. 2, for the gate lines GLm-2 to GLm, gate voltages are sequentially output from the gate driver 2. The gate lines GL1 to GLm are sequentially selected, and the thin film transistors TFT connected to the selected gate line GL1 to GLm are turned on. The data driver 2 is supplied with the data signals and outputs data voltages to the data lines DL1 to DLn in accordance that each gate line GL1 to GLm is selected.

Even though not shown in the drawing, the driving circuit includes a timing controller, a gamma reference voltage generator, a power supply and an interface. The interface is supplied with the data signals and control signals such as a vertical synchronization signal, a horizontal synchronization signal, a data enable signal, and a data clock signal. The data signals and control signals are supplied from an external system, such as a computer system. The timing controller is supplied with the control signals from the interface and generates control signals to control the gate and data drivers 2 and 1. The timing controller processes the data signals and supplies those to the data driver 1. The gate driver 2 is supplied with the control signals from the timing controller to sequentially output the gate voltages to the gate lines GL1 to GLm. The data driver 1 is supplied with the data signals and the control signals from the timing controller. The gamma reference voltage generator generates gamma reference voltages which are supplied to the data driver 1. The power supply supplies voltages that operate the components of the LCD device.

The related art LCD device may be categorized into a normally white mode LCD device and a normally black mode LCD device. The normally white mode LCD device is operated in a manner that white is displayed when an off-level data voltage is applied, and the normally black mode LCD device is operated in a manner that black is displayed when an off-level data voltage is applied.

FIG. 3 is a view illustrating a graph of a time and voltage and a graph of a time and a transmittance in a normally white mode LCD device according to the related art.

Referring to FIG. 3, when a second data voltage Va to display black is applied from a first data voltage (=0V), a response time of the LCD device is ta. When the first data voltage to display white is applied from the second data voltage Va, a response time is tb. The response time tb for white is more than the response time ta for black. White and black are highest and lowest gray levels, respectively, of the LCD device.

Various factors such as a data voltage, parasitic capacitances, a driving method, a liquid crystal material and the like have influence on the response time. A main factor having influence on the liquid crystal response time ta for black is a data voltage out of the various factors. In the meantime, the response time tb for white is influenced more by other factors than the data voltage. This is one of reasons that the response time tb for white is more than the response time ta for black, or response times for gray levels between white and black.

The related art LCD device may be operated in an over-driving method to decrease a response time. The over-driving method is to use a principle that a response time becomes faster as a data voltage having a level higher or lower than a level of an original data voltage required to display a certain gray level is applied first for an over-driving time out of a data-applying time. The data-applying time is a time when a data voltage is applied from the data driver (1 of FIG. 1) through the corresponding data line (DL1 to DLm of FIG. 1) to the corresponding pixel. When a gray level of the present frame is higher than that of the previous frame, a data voltage, which has a level higher than that a level of an original data voltage required to display the gray level of the present frame, is applied first for an over-driving time. When a gray level of the present frame is lower than that of the previous frame, a data voltage, which has a level lower than a level of an original data voltage required to display the gray level of the present frame, is applied first for an over-driving time. Accordingly, liquid crystal molecules rotate faster, thus a transmittance required for the gray level of the present is reached faster and a response time becomes faster. After the over-driving time, the original data voltage is applied for the rest time out of a data-applying time. After the data-applying time, the original data voltage is stored in the corresponding pixel and the transmittance is maintained in the present frame.

FIG. 4 is a view illustrating an over-driving method of the related art normally white mode LCD device.

Referring to FIG. 4, a third data voltage Vb having a level higher than a level of a second data voltage Va as an original data voltage to display black is applied first for an over-driving time. Because of the over-driving method, a response time is reduced to a time tc less than the response time (ta of FIG. 3). However, because a first data voltage to display white is 0V, there exists no voltage having a level than 0V. Accordingly, the over-driving method can not be applied to display white and a response time tb is not reduced.

SUMMARY

Accordingly, the present invention is directed to a liquid crystal display module that substantially obviates one or more of the problems due to limitations and disadvantages of the related art.

An advantage of the present invention is to provide a liquid crystal display device and method of driving the same which can reduce response time for white.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal panel including a liquid crystal layer; and a driving circuit including a data driver supplying a data voltage to the liquid crystal panel, wherein the liquid crystal panel displays white at a first data voltage and black at a second data voltage, and wherein a level of the first data voltage is higher than 0V and a level of the second data voltage is higher than the level of the first data voltage.

In another aspect of the present invention, a method of driving a liquid crystal display device includes applying a first data voltage to a pixel of a liquid crystal panel first for a first time out of a first data-applying time in a first frame, the liquid crystal panel including a liquid crystal layer; and applying a second data voltage displaying white to the pixel for a second time out of the first data-applying time after the first time, wherein a level of the second data voltage is higher than 0V and lower than a level of a third data voltage displaying black, and a level of the first data voltage is within a range of equal to or higher than 0V and lower than the level of the second data voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 2 is a waveform view illustrating gate voltages output from a gate driver of FIG. 1;

DETAILED DESCRIPTION

Reference will now be made in detail to an embodiment of the present invention, examples of which is illustrated in the accompanying drawings.

Figure 5:
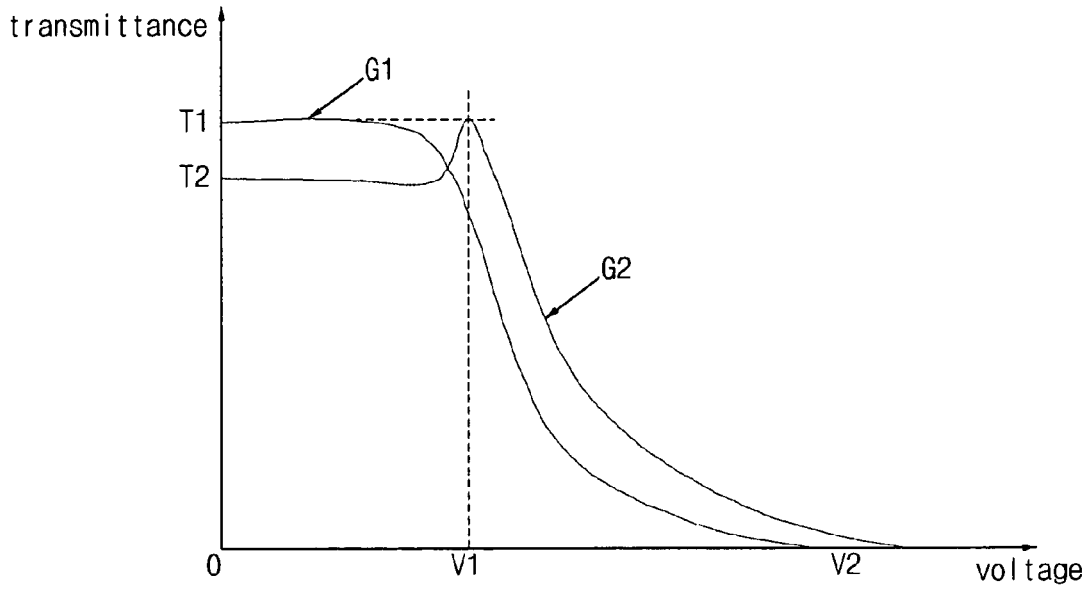
FIG. 5 is a view illustrating a V-T (voltage-transmittance) graph of an LCD device according to the embodiment of the present invention and a V-T graph of an LCD device of the related art.

FIG. 5 is a view illustrating a V-T (voltage-transmittance) graph of an LCD device according to the embodiment of the present invention and a V-T graph of an LCD device of the related art.

The LCD device according to the embodiment may include a liquid crystal panel and a driving circuit similar to those of the related art. Explanations of parts similar to parts of the related art may be omitted.

The LCD device according to the embodiment may be operated in a normally white mode. The LCD device according to the embodiment may be operated in an over-driving method.

The LCD device according to the embodiment may be operated in a TN (twisted nematic) mode or an ECB (electrical controlled birefringence) mode. The TN mode LCD device includes a TN mode liquid crystal material interposed between first and second substrates of the LCD device, and first and second alignment layers on inner surfaces of the first and second substrates, respectively. The first alignment layer has a first rubbing direction perpendicular to a second rubbing direction of the second alignment layer. Accordingly, TN mode liquid crystal molecules are arranged to be twisted with 90 degrees angle along a direction perpendicular to a plane of the substrates when an electric field between the two substrates is not applied, and arrangement of the TN mode liquid crystal molecules are changed in accordance with the electric filed applied between the two substrates.

The ECB mode LCD device includes an ECB mode liquid crystal material interposed between first and second substrates of the LCD device, and first and second alignment layers on inner surfaces of the first and second substrates, respectively. The first alignment layer has a first rubbing direction parallel to a second rubbing direction of the second alignment layer. For example, the first and second rubbing directions are the same direction or opposite direction. Accordingly, ECB mode liquid crystal molecules are arranged according to the rubbing directions of the first and second alignment layers, and arrangement of the ECB mode liquid crystal molecules are changed in accordance with the electric filed applied between the two substrates.

The LCD device according to the embodiment may be operated in an over-driving method even when white is displayed, differently from the related art.

Referring to FIG. 5, while the related art LCD device is operated according to a first graph G1, the LCD device according to the embodiment is operated according to a second graph G2. The second graph G2 shows that white is displayed at a first data voltage V1 having a level higher than 0V which is to display white as shown in the first graph G1 of the related art LCD device, and black is displayed at a second data voltage V2.

To set the first voltage V1 having a level higher than 0V, the LCD device according to the embodiment may have a retardation value of a liquid crystal material more than that of the related art LCD device. The related art TN mode LCD device has a retardation value of a TN mode liquid crystal material of 480 nm, and the related art ECB mode LCD device has a retardation value of an ECB mode liquid crystal material of 275 nm. The retardation value is determined by a expression, $R=\Delta n*d$ (R is a retardation value, $\Delta n$ is a refraction index difference of an extra-ordinary refraction index (ne) and an ordinary refraction index (no) of a liquid crystal molecule, and d is a thickness of a liquid crystal layer). Accordingly, the TN mode LCD device according to the embodiment may have a retardation value more than 480 nm, and the ECB mode LCD device according to the embodiment may have a retardation value more than 275 nm. For example, the TN mode LCD device may have a retardation value within a range of about 104% to 130% of 480 nm i.e., about 500 nm to 624 nm, and the ECB mode LCD device may have a retardation value within a range of about 104% to 130% of 275 nm i.e., about 286 nm to 357 nm. To have this retardation value, at least one of the refraction index difference and the thickness of the liquid crystal layer may be adjusted. The second graph G2 of FIG. 5 is a graph when the TN mode LCD device has a retardation value of about 600 nm.

As described above, by adjusting the retardation value appropriately, the LCD device has the second graph G2 to perform an over-driving method even when displaying white.

Figure 6:
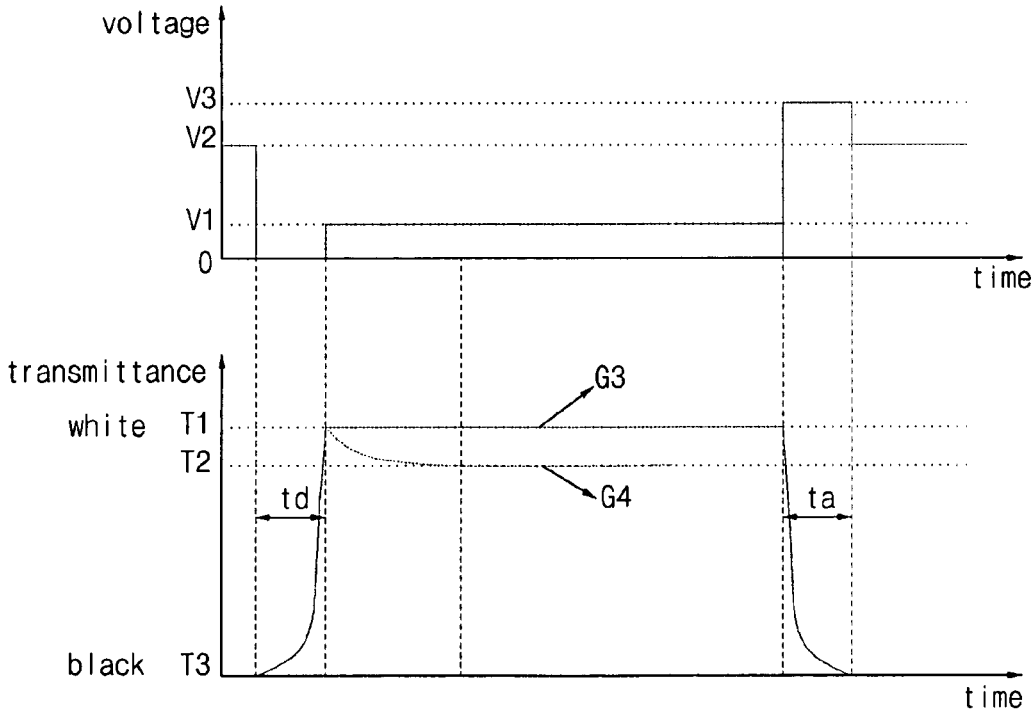
FIG. 6 is a view illustrating a method of driving an LCD device according to the embodiment of the present invention.

FIG. 6 is a view illustrating a method of driving an LCD device according to the embodiment of the present invention.

Referring to FIGS. 5 and 6, black is displayed at a pixel in the previous frame by a second data voltage V2. To display white in the present frame, a data voltage, which has a level within a range of equal to or higher than 0V and lower than a level of a first data voltage V1, is applied first for a first over-driving time out of a data-applying time. Assuming that the data voltage is 0V. Liquid crystal molecules rotates faster when 0V is applied than when the first voltage as an original data voltage required to display white is applied, and thus state of the liquid crystal molecules to display white having the first transmittance T1 is reached faster. If 0V were still applied after the first over-driving time, the liquid crystal molecules would finally have a state to have the second transmittance T2, according to a fourth graph G4 in FIG. 6, less than the first transmittance T1 for white. The fourth graph G4 shows variation of a transmittance when 0V is still applied, based upon the first graph G1. Accordingly, after the first over-driving time i.e., the first transmittance T1 is reached by applying 0V, the first data voltage V1 is applied for the rest time out of the data-applying time, and thus the first transmittance T1 is maintained as shown in a third graph G3 of FIG. 6.

Figure 1:
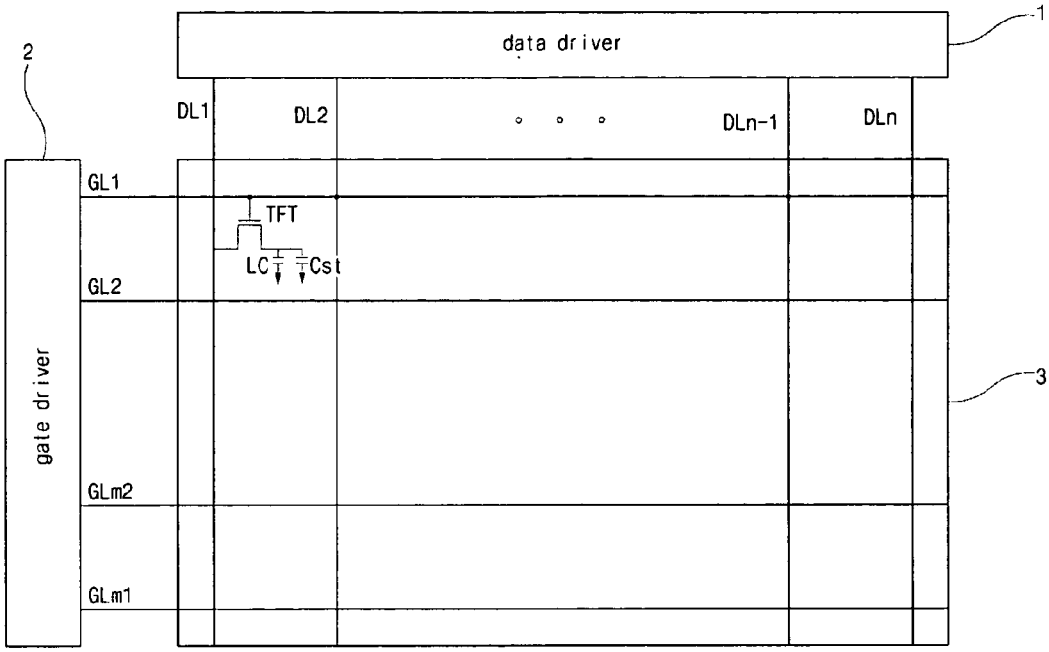
FIG. 1 RELATED ART
FIG. 1 is a block diagram of an LCD device according to the related art.
Figure 2:
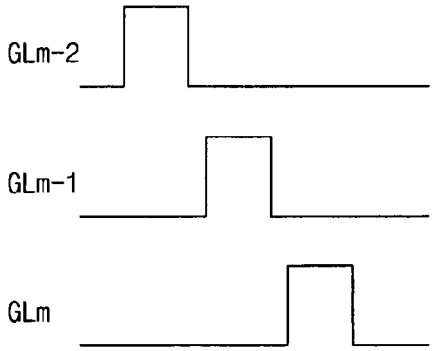
FIG. 2 RELATED ART
FIG. 2 is a circuit diagram of a liquid crystal panel of FIG. 1.
Figure 3:
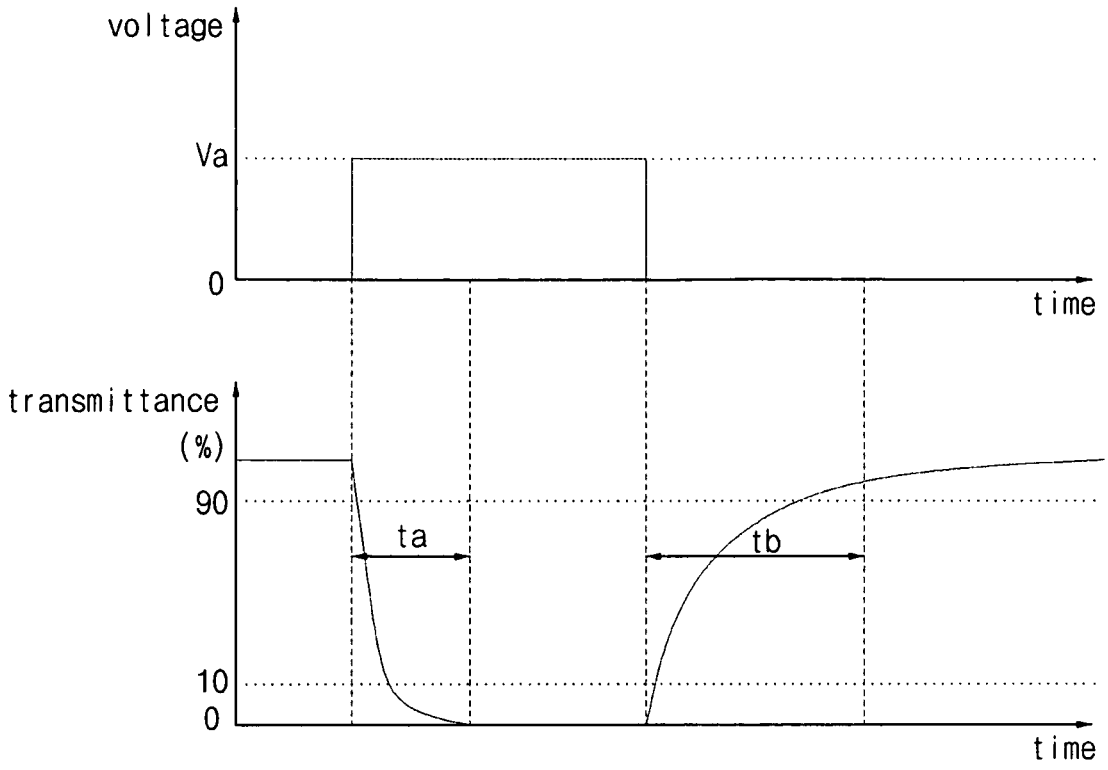
FIG. 3 RELATED ART
FIG. 3 is a view illustrating a graph of a time and voltage and a graph of a time and a transmittance in a normally white mode LCD device according to the related art.
Figure 4:
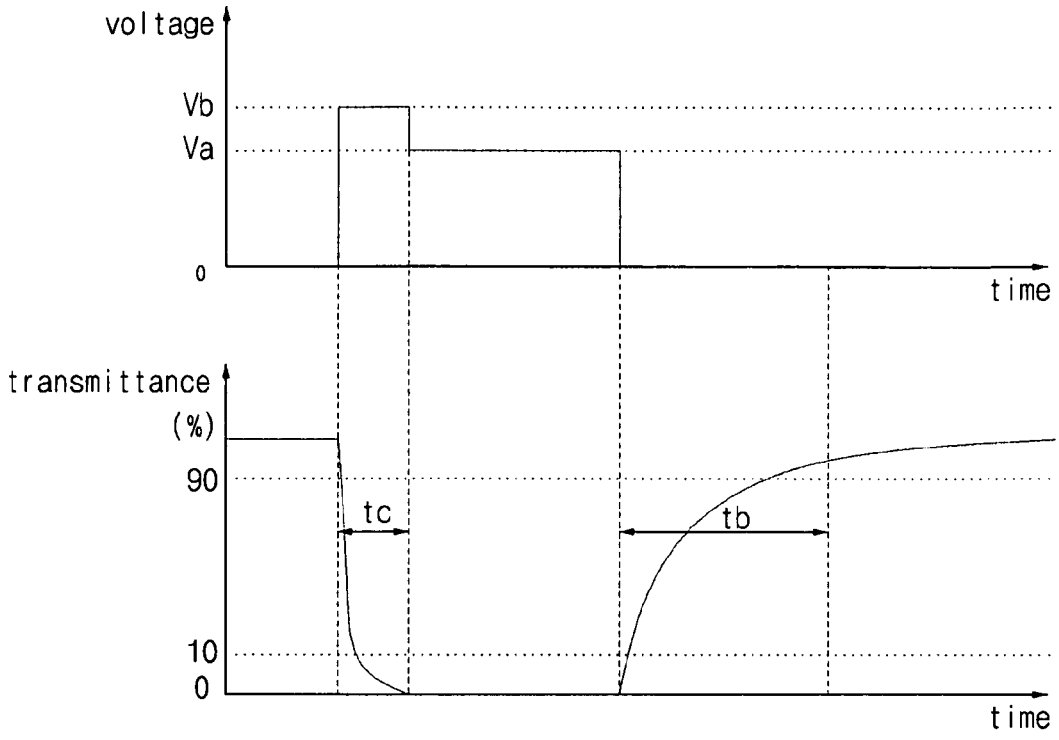
FIG. 4 RELATED ART
FIG. 4 is a view illustrating an over-driving method of the related art normally white mode LCD device.

As described above, by setting the data voltage for white to have a level higher 0V, the over-driving can be performed to display white in a manner that the data voltage having a level within a range of equal to or higher than 0V and lower than the level of the data voltage to display white is applied first for the first over-driving time. Therefore, a response time for white can be reduced to a time td less than the response time (tb of FIG. 4) of the related art.

After the data-applying time, the first data voltage V1 is stored in the pixel and the first transmittance T1 is maintained in the present frame. Then, to display a gray level darker than white, for example, black in the next frame, a third data voltage V3 is applied first for a second over-driving time out of a data-applying time. The third data voltage V3 has a level higher than a level of the second data voltage V2 as an original data voltage required to display black, to perform an over-driving for black. Accordingly, liquid crystal molecules rotates faster when the third data voltage V3 is applied than the second voltage V2 is applied, and thus state of the liquid crystal molecules to display black having a third transmittance T3 is reached faster. After the second over-driving time i.e., the third transmittance T3 is reached by applying the third data voltage V3, the second data voltage V2 is applied for the rest time out of the data-applying time, and thus the third transmittance T3 is maintained.

As described in the embodiment of the present invention, the LCD device can be operated in the over-driving method not only when displaying gray levels darker than white but also when displaying black by setting the white data voltage to have a level higher 0V. Accordingly, the LCD device can have fast response times for all of gray levels, and display quality can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel including a liquid crystal layer; and a driving circuit including a data driver supplying a data voltage to the liquid crystal panel, wherein the liquid crystal panel displays white at a first data voltage and black at a second data voltage, and wherein a level of the first data voltage is higher than 0V and a level of the second data voltage is higher than the level of the first data voltage, and wherein a transmittance of the liquid crystal panel at the first data voltage is greater than that at a voltage lower than the first data voltage and that at a voltage higher than the first data voltage.

2. The device of claim 1, wherein a first retardation value of the liquid crystal layer for the liquid crystal panel to display white at the first data voltage is more than a second retardation value of the liquid crystal layer for the liquid crystal panel to display white at 0V.

3. The device of claim 2, wherein the liquid crystal layer is a TN mode liquid crystal layer, and the first retardation value is within a range of about 500 nm to 624 nm.

4. The device of claim 2, wherein the liquid crystal layer is an ECB mode liquid crystal layer, and the first retardation value is within a range of about 286 nm to 357 nm.

5. A method of driving a liquid crystal display device, comprising:

applying a first data voltage to a pixel of a liquid crystal panel first for a first time out of a first data-applying time in a first frame, the liquid crystal panel including a liquid crystal layer; and applying a second data voltage displaying white to the pixel for a second time out of the first data-applying time after the first time, wherein a level of the second data voltage is higher than 0V and lower than a level of a third data voltage displaying black, and a level of the first data voltage is within a range of equal to or higher than 0V and lower than the level of the second data voltage, and wherein a transmittance of the liquid crystal panel at the second data voltage is greater than that at a voltage lower than the second data voltage and that at a voltage higher than the second data voltage.

6. The method of claim 5, wherein a first retardation value of the liquid crystal layer for the liquid crystal panel to display white at the second data voltage is more than a second retardation value of the liquid crystal layer for the liquid crystal panel to display white at 0V.

7. The method of claim 6, wherein the liquid crystal layer is a TN mode liquid crystal layer, and the first retardation value is within a range of about 500 nm to 624 nm.

8. The method of claim 6, wherein the liquid crystal layer is an ECB mode liquid crystal layer, and the first retardation value is within a range of about 286 nm to 357 nm.

9. The method of claim 5, further comprising:

applying a fourth data voltage to the pixel first for a third time out of a second data-applying time in a second frame;

applying the third data voltage to the pixel for a fourth time out of the second data-applying time after the third time, wherein a level of the fourth data voltage is higher than the level of the third data voltage.

* * * * *